US007250912B2

(12) United States Patent
Minoura

(10) Patent No.: US 7,250,912 B2
(45) Date of Patent: Jul. 31, 2007

(54) FIXING STRUCTURE

(75) Inventor: Yasuhiro Minoura, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 65 days.

(21) Appl. No.: 11/011,082

(22) Filed: Dec. 15, 2004

(65) Prior Publication Data

US 2005/0179613 A1 Aug. 18, 2005

(30) Foreign Application Priority Data

Dec. 16, 2003 (JP) ..... P2003-417929

(51) Int. Cl.
*H01Q 1/24* (2006.01)

(52) U.S. Cl. ..... 343/702; 343/906

(58) Field of Classification Search ..... 343/878, 343/702, 906

See application file for complete search history.

(56) References Cited

U.S. PATENT DOCUMENTS 6,215,446 B1 4/2001 Sullivan et al.
7,046,206 B2 * 5/2006 Minoura et al. ..... 343/702
2001/0004248 A1 6/2001 Takagi et al.
2002/0101380 A1 8/2002 Pruss et al.

FOREIGN PATENT DOCUMENTS

DE 298 11 273 U1 10/1998
JP 2000-252727 A 9/2000
JP 2002-141719 A 5/2002

* cited by examiner

*Primary Examiner*—Thuy V. Tran
*Assistant Examiner*—Dieu Hien Duong
(74) *Attorney, Agent, or Firm*—Morgan, Lewis & Bockius LLP

(57) ABSTRACT

A first member is formed with a hole having an inner wall formed with a recess at a first circumferential position. A second member is formed with an elastic retainer which is retractably projected from an outer peripheral face of the second member and engaged with the recess when the second member is fitted into the hole. A chamfered portion is formed on an aperture edge of the hole at the first circumferential position, so as to have a width allowing the retainer to pass therethrough when the second member is fitted into the hole.

4 Claims, 9 Drawing Sheets

FIXING STRUCTURE

BACKGROUND OF THE INVENTION

The present invention relates to a fixing structure including a first member having a hole provided with a recess or cutout on an inner peripheral face thereof, and a second member provided with a tongue piece which is projected outwardly and can be elastically deformed inwardly, wherein the second member is inserted into the hole, and the tongue piece is engaged with the recess or cutout, thereby to restrict withdrawal of the second member.

An example of a mounting structure for an antenna of a cellular phone or the-shaped is disclosed in Japanese Patent Publication No. 2000-252727A. In this example, an antenna attachment is provided with a tongue piece projected outwardly from an outer peripheral face of the antenna attachment and can be elastically deformed inwardly. The antenna attachment is inserted into a hole formed in a casing body, while the tongue piece is elastically deformed inwardly, and when the engaging part of the tongue piece has reached an inside end of the hole in the casing body, the tongue piece will be elastically restored to engage with the edge of the inside end of the hole. In this manner, withdrawal of the antenna attachment will be restricted. Moreover, a slanted face or a curved face is provided on the edge of the hole so as to extend a circumferential direction thereof, so that the tongue piece can be elastically deformed inwardly when the antenna attachment is rotated around an axis thereof in the circumferential direction.

In this structure, by inserting the antenna attachment into the hole for engagement, the withdrawal will be restricted, and the antenna attachment can be easily fixed to the casing body. Moreover, the antenna attachment can be easily detached from the casing body, by rotating the fixed antenna attachment in the circumferential direction of the hole to disengage the tongue piece from the inside edge of the hole. In this manner, the replacement of the antenna can be easily conducted.

In the above structure, it is necessary to make a position of the tongue piece aligned, in an axial direction of the antenna attachment, with a position of the inside edge of the hole in the casing body where the tongue piece is to be engaged with, when the antenna attachment is inserted into the hole. However, since there is no member for bringing the antenna attachment into a prescribed posture in the circumferential direction of the hole, an inserting operation is conducted depending on intuition of a worker.

SUMMARY OF THE INVENTION

It is therefore an object of the invention to provide a fixing structure in which an attached member is easily placed in a prescribed position.

In order to achieve the above object, according to the invention, there is provided a fixing structure, comprising:

a first member, formed with a hole having an inner wall formed with a recess at a first circumferential position; and a second member, formed with an elastic retainer which is retractably projected from an outer peripheral face of the second member and engaged with the recess when the second member is fitted into the hole, wherein a chamfered portion is formed on an aperture edge of the hole at the first circumferential position, so as to have a width allowing the retainer to pass therethrough when the second member is fitted into the hole.

With this configuration, since the chamfered portion is formed at the first circumferential position, the retainer is reliably placed in a position to be engaged with the recess by positioning the retainer at the chamfered portion when the second member is inserted into the hole. In addition, the retainer is gradually pushed inward during the passage of the chamfered portion. Accordingly, the inserting operation of the second member can be smoothly executed.

Preferably, at least one of an outer face of the retainer and a side face of the recess is formed with a slanted face which causes the retainer to be retracted inward when the second member is rotated within the hole in a circumferential direction of the hole from the state that the retainer engages with the recess.

With this configuration, the engagement between the recess and the retainer is released by circumferentially rotating the second member within the hole. Accordingly, the detachment of the second member from the first member can be easily executed with simple operation.

According to the invention, there is also provided a fixing structure, comprising:

a first member, formed with a hole having an inner wall formed with a recess at a first circumferential position and a first groove at a second circumferential position, the first groove extending from an aperture edge of the hole in an axial direction of the hole; and a second member, formed with a projection on an outer peripheral face thereof, and an elastic retainer which is retractably projected from the outer peripheral face and engaged with the recess when the second member is fitted into the hole, wherein the projection and the retainer are so arranged that the retainer is placed at the first circumferential position of the hole when the projection is received by the first groove to fit the second member into the hole.

With this configuration, the retainer is reliably placed in a position to be engaged with the recess by inserting the projection into the first groove when the second member is inserted into the hole. Accordingly, the inserting operation of the second member can be smoothly executed.

Preferably, the inner wall of the hole is formed with a second groove at a third circumferential position so as to extend from the aperture edge of the hole in the axial direction of the hole, and a third groove extending in a circumferential direction of the hole so as to connect the first groove and the second groove. At least one of an outer face of the retainer and a side face of the recess is formed with a slanted face. The slant face causes the retainer to be retracted inward while the projection moves to the second groove through the third groove, when the second member is rotated within the hole in the circumferential direction of the hole from the state that the retainer engages with the recess.

With this configuration, the engagement between the recess and the retainer is released by circumferentially rotating the second member within the hole. Accordingly, the detachment of the second member from the first member can be easily executed with simple operation, by passing the projection through the second groove.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Preferred embodiments of the invention will be described below in detail with reference to the accompanying drawings.

First, a first embodiment of the invention will be described with reference to FIGS. 1A to 7 for a case where an antenna is fixed to a casing body of a cellular phone, such that the antenna is withdrawably accommodated within the casing body.

Figures 1A, 1B, 1C, 1D:
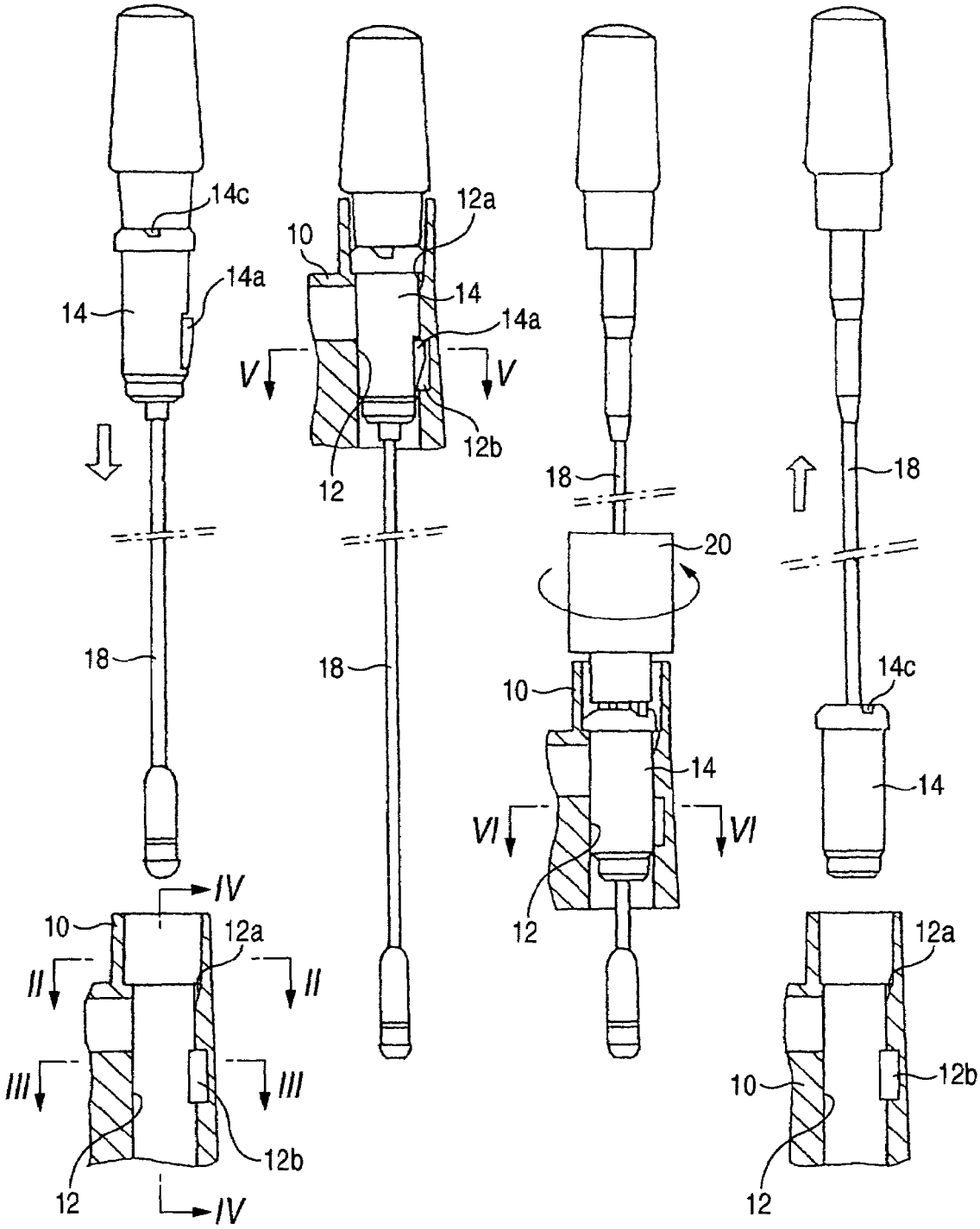
FIG. 1A is a partial section view of a fixing structure according to a first embodiment of the invention, showing a state before an antenna is inserted into a hole formed in a casing body.
FIG. 1B is a partial section view of the fixing structure of FIG. 1A, showing a state after the antenna is inserted into the hole.
FIG. 1C is a partial section view of the fixing structure of FIG. 1A, showing a state before the antenna is removed from the hole.
FIG. 1D is a partial section view of the fixing structure of FIG. 1A, showing a state after the antenna is removed from the hole.
Figure 2:
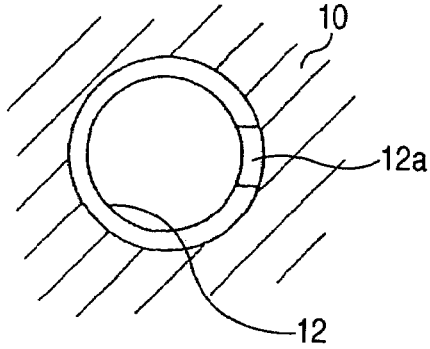
FIG. 2 is a section view taken along a line II-II in FIG. 1A.
Figure 3:
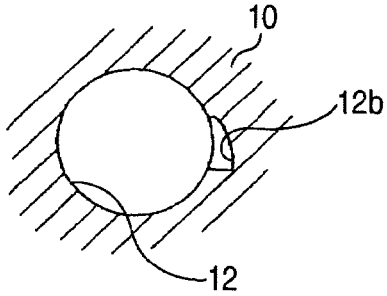
FIG. 3 is a section view taken along a line III-III in FIG. 1A.
Figure 4:
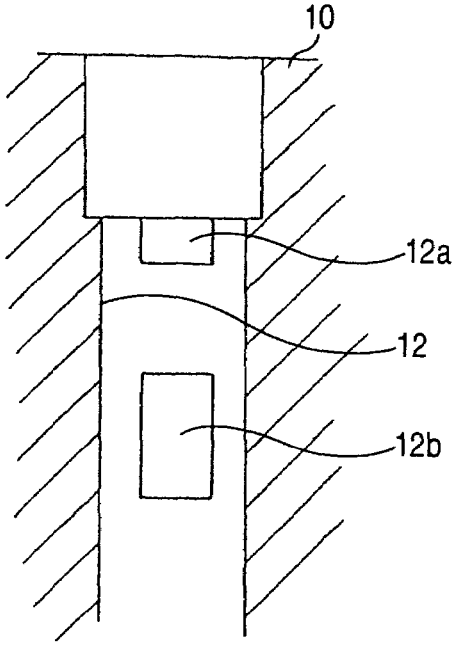
FIG. 4 is a section view taken along a line IV-IV in FIG. 1A.

As shown in FIGS. 1A, 2 and 4, a casing body 10 of the cellular phone serving as a first member is provided with a through hole 12. A chamfered part 12*a* is formed on an outside edge of this hole 12, and a recess 12*b* is formed on an inner peripheral face of the hole 12 at the same circumferential position as this chamfered part 12*a*.

Figure 7A:
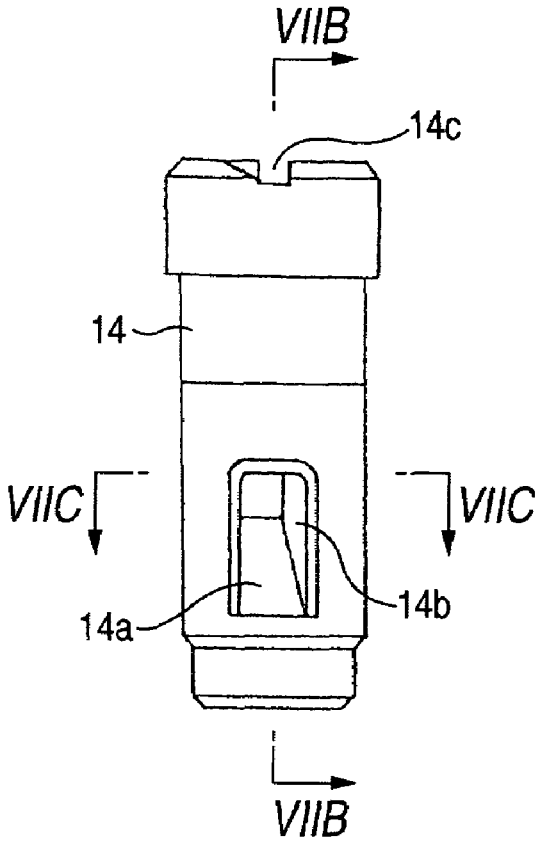
FIG. 7A is a side view of an attachment member in the antenna of FIG. 1A.
Figure 7B:
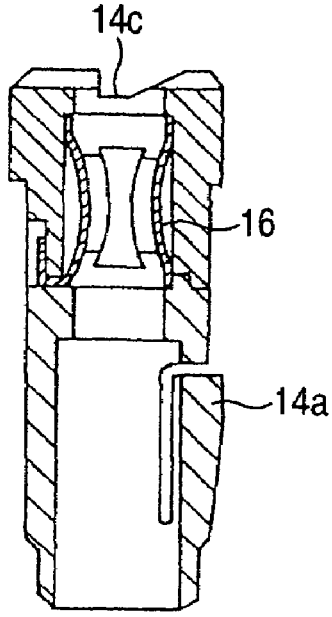
FIG. 7B is a section view taken along a line VIIB-VIIB in FIG. 7A.
Figure 7C:
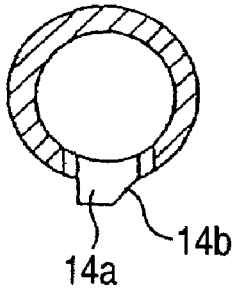
FIG. 7C is a section view taken along a line VIIC-VIIC in FIG. 7A.

On the other hand, as shown in FIGS. 7A and 7C, an antenna 14 serving as a second member is formed of resin or the like, and a tongue piece 14*a* is formed on the antenna 14 in a cantilevered manner. A free end of this tongue piece 14*a* is projected outwardly from an outer peripheral face of the antenna 14, and adapted to be elastically deformed inwardly in a radial direction of the antenna 14. An outer face of the tongue piece 14*a* is in a form of a smooth slope from the base end to the free end, and a chamfered slope face 14*b* is formed on the tongue piece 14*a* at one side in a circumferential direction.

Further, as shown in FIGS. 7A and 7B, the antenna 14 is provided, on its upper face, with a groove 14*c* configured such that the antenna 14 can be rotated only in one direction around the axis. The antenna 14 is in a substantially cylindrical shape, and contains a power supply spring 16 arranged on its inner peripheral face. The power supply spring 16 is appropriately brought into elastic contact with a rod-shaped antenna element 18 which is withdrawably inserted into the antenna 14, thereby to be electrically connected thereto.

Figure 5:
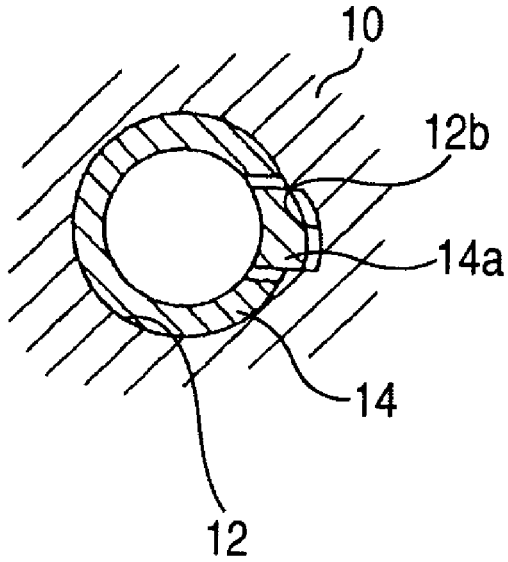
FIG. 5 is a section view taken along a line V-V in FIG. 1B.

In this structure, as shown in FIG. 1A, the antenna 14 is inserted into the hole 12, while the tongue piece 14*a* of the antenna 14 is aligned with the chamfered part 12*a* of the hole 12 relative to the circumferential direction. In this embodiment, the chamfered part 12*a* has such a width as allowing the tongue piece 14*a* to pass through. On occasion of this insertion, the tongue piece 14*a* is elastically deformed inward by a guide of the chamfered part 12*a*, so that smooth insertion of the antenna 14 is permitted. Moreover, when the insertion is proceeded by a prescribed amount to make the tongue piece 14*a* opposed to the recess 12*b*, the tongue piece 14*a* is elastically restored to be brought into an engaged state as shown in FIGS. 1B and 5, and withdrawal of the antenna 14 is restricted. Because the recess 12*b* and the chamfered part 12*a* are formed at the same circumferential positions, the tongue piece 14*a* can be reliably engaged with the recess 12*b*.

Figure 6:
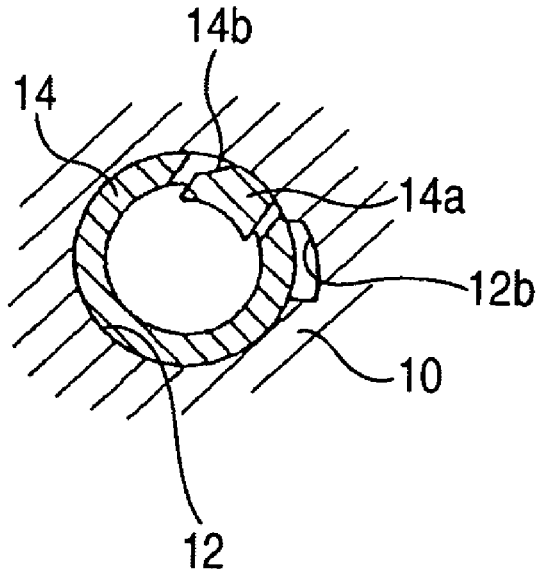
FIG. 6 is a section view taken along a line VI-VI in FIG. 1C.

As shown in FIGS. 1C and 6, when the antenna 14 is rotated in a prescribed direction around the axis by fitting a remover 20 into the groove 14*c* of the antenna 14, the slope face 14*b* of the tongue piece 14*a* is brought into contact with a side edge of the recess 12*b* in the circumferential direction, and a force for pressing the tongue piece 14*a* inwardly is exerted by a wedge effect. Then, the tongue piece 14*a* is elastically deformed inwardly to be disengaged from the recess 12*b*, so that the rotation of the antenna 14 is permitted. Thereafter, in a state where the tongue piece 14*a* is out of engagement, the antenna 14 can be withdrawn from the hole 12 to be detached, as shown in FIG. 1D.

With the above described structure, since the circumferential position of the tongue piece 14*a* of the antenna 14 can be aligned with the position of the recess 12*b* because of presence of the chamfered part 12*a* of the hole 12, it is possible to engage the tongue piece 14*a* with the recess 12*b* reliably and easily along with the insertion. In addition, since the tongue piece 14*a* can be disengaged by rotating the antenna 14 with the aid of the slope face 14*b* formed on the tongue piece 14*a*, the antenna 14 can be easily detached from the casing body 10. In this manner, an exchange or the like of the antenna 14 can be easily conducted.

Next, a second embodiment of the invention will be described with reference to FIGS. 8A to 12 for a case where a circuit board or the like is fixed to a casing body of an equipment.

Figure 8A:
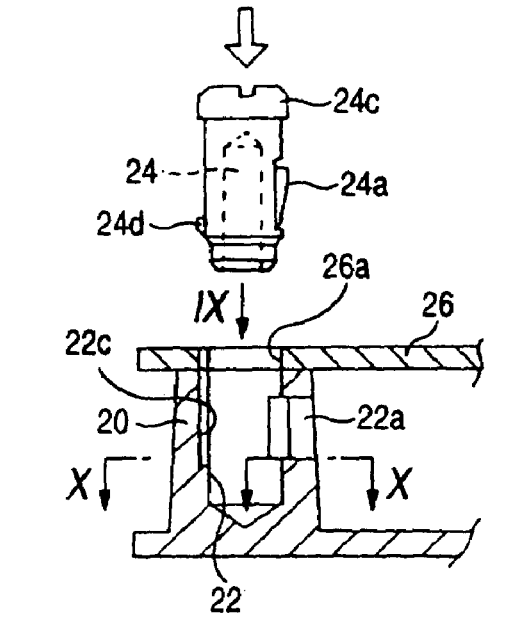
FIG. 8A is a partial section view of a fixing structure according to a second embodiment of the invention, showing a state before a pin member is inserted into a hole formed in a boss member.
Figure 8B:
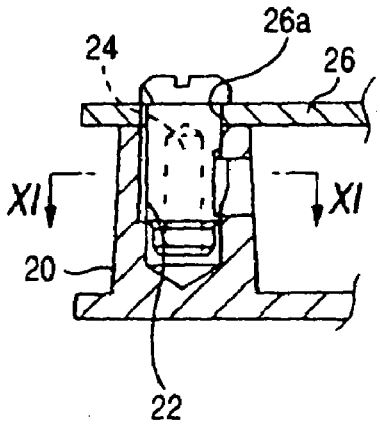
FIG. 8B is a partial section view of the fixing structure of FIG. 8A, showing a state after the pin member is inserted into the hole.
Figure 9:
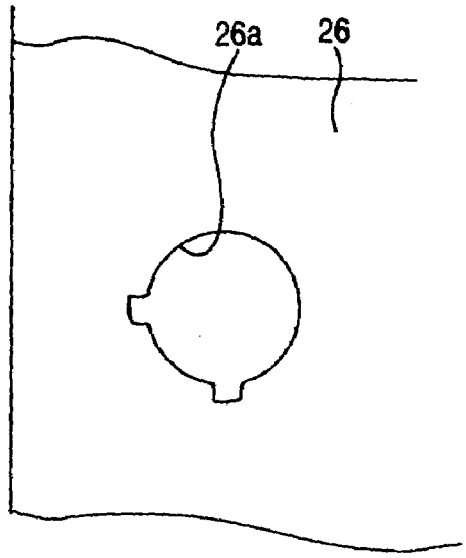
FIG. 9 is a plan view of the hole viewed from a direction indicated by an arrow IX in FIG. 8A.
Figure 10:
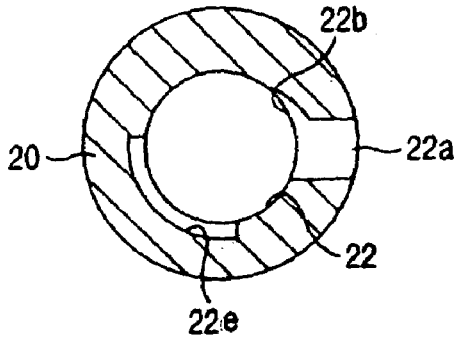
FIG. 10 is a section view taken along a line X-X in FIG. 8A.
Figure 11:
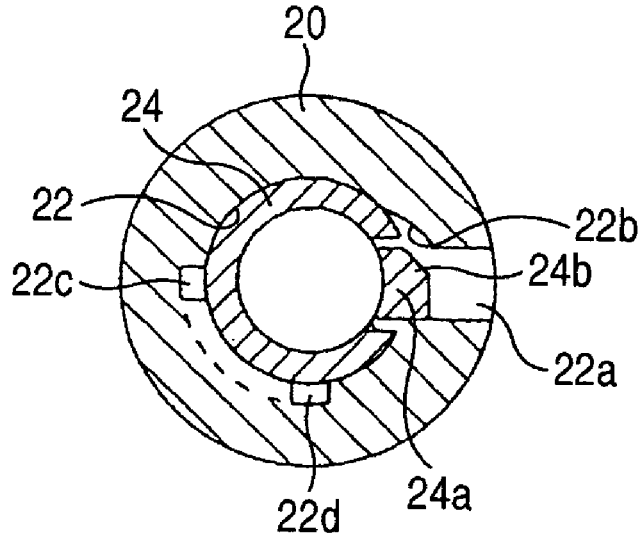
FIG. 11 is a section view taken along a line XI-XI in FIG. 8B.

As shown in FIGS. 8A, 9 and 10, a boss member 20 serving as a first member which is provided on the casing body of the equipment is formed with a hole 22. A cutout 22*a* is formed on an inner peripheral face of the hole 22, and a slanted face 22*b* is provided on a side edge of the cutout 22*a* in a circumferential direction of the hole 22. Moreover, two vertical grooves 22*c*, 22*d* are formed so as to extend in an axial direction from an outside edge of the hole 22, and these two vertical grooves 22*c*, 22*d* are communicated with each other by a circumferential groove 22*e*.

On the other hand, as shown in FIG. 8A, a pin member 24 serving as a second member is provided with a tongue piece 24*a* formed thereon in a cantilevered manner. A free end of this tongue piece 24*a* is projected outwardly from an outer peripheral face of the pin member 24, and adapted to be elastically deformed inwardly in the radial direction of the pin member 24. An outer face of the tongue piece 24*a* is in a form of a smooth slope from the base end to the free end, and a slanted face 24*b* is formed on the tongue piece 24*a* at one side in a circumferential direction which is adapted to be contacted with the slanted face 22*b* in the cutout 22*a* of the hole 22. A swelled part 24*c* is formed at an upper end of the pin member 24.

Figure 8C:
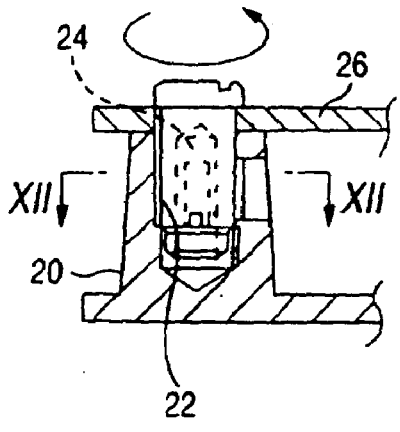
FIG. 8C is a partial section view of the fixing structure of FIG. 8A, showing a state before the pin member is removed from the hole.
Figure 12:
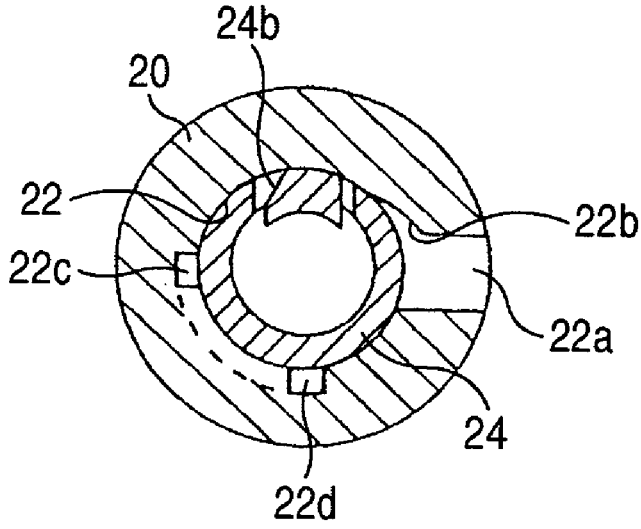
FIG. 12 is a section view taken along a line XII-XII in FIG. 8C.

The pin member 24 is provided with a projection 24*d* on its outer peripheral face near a lower end thereof. The projection 24*d* is formed so as to be opposed to one of the vertical grooves 22*c* when the tongue piece 24*a* is aligned with the cutout 22*a* relative to the circumferential direction of the hole 22. Moreover, when the pin member 24 is rotated in such a manner that the slanted face 24*b* of the tongue piece 24*a* may be brought into contact with the slanted face 22*b* of the cutout 22*a* as shown in FIG. 8C, the projection 24*d* is so configured to pass through the circumferential groove 22*e*. Then, in a state where the tongue piece 24*a* is elastically deformed inwardly along with a further rotation of the pin member 24, and disengaged from the cutout 22*a* as shown in FIG. 12. At the same time, the projection 24*d* passes through the circumferential groove 22*e* to arrive at the other vertical groove 22*d*, thereby to restrict the rotation of the pin member 24.

As shown in FIG. 9, a circuit board 26 to be fixed to the boss member 20 is provided with a hole 26*a* having a shape corresponding to an opening of the hole 22 formed with the two vertical grooves 22*c*, 22*d*.

With the above described structure, the circuit board 26 is placed on the boss member 20, and the pin member 24 is inserted into the hole 22, having the hole 26*a* of the circuit board 26 aligned with the hole 22. On occasion of this insertion, the projection 24*d* of the pin member 24 is brought into a position aligned with the one vertical groove 22*c* in the circumferential direction of the hole 22. Then, the projection 24*d* passes through the one vertical groove 22*c*, and the tongue piece 24*a* is elastically deformed to permit the insertion. When the tongue piece 24*a* is inserted up to the position opposed to the cutout 22*a*, the tongue piece 24*a* is elastically restored to be engaged with the recess 22*a*. At the same time, the projection 24*d* arrives at a bottom end of the vertical groove 22*c*, and the insertion is restricted. In this manner, the circuit board 26 can be easily fixed to the boss member 20.

Then, by appropriately rotating the pin member 24 in the engaged state, the slanted face 24*b* of the tongue piece 24*a* comes in contacted with the slanted face 22*b* of the cutout 22*a*, so that the tongue piece 24*a* is elastically deformed inwardly to be disengaged from the cutout 22*a*. At the same time, the projection 24*d* passes through the circumferential groove 22*e*, and arrives at a terminal end of the circumferential groove 22*e* in the disengaged state, thereby to restrict the rotation. On this occasion, the projection 24*d* is allowed to pass through the other vertical groove 22*d*, and the pin member 24 can be withdrawn from the hole 22. In this manner, the circuit board 26 can be easily detached from the boss member 20.

Figure 14:
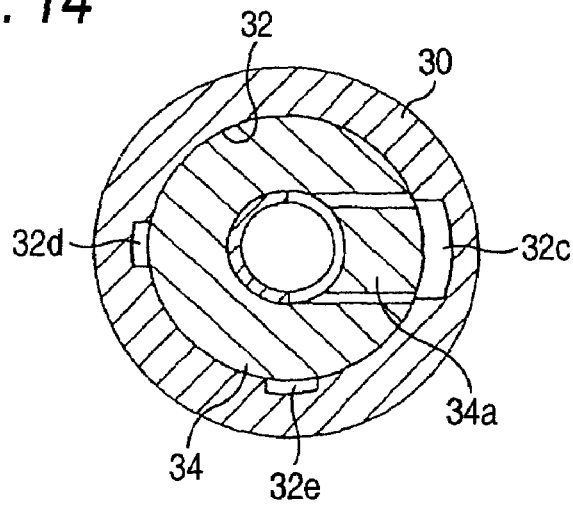
FIG. 14 is a section view taken along a line XIV-XIV in FIG. 13.
Figure 15:
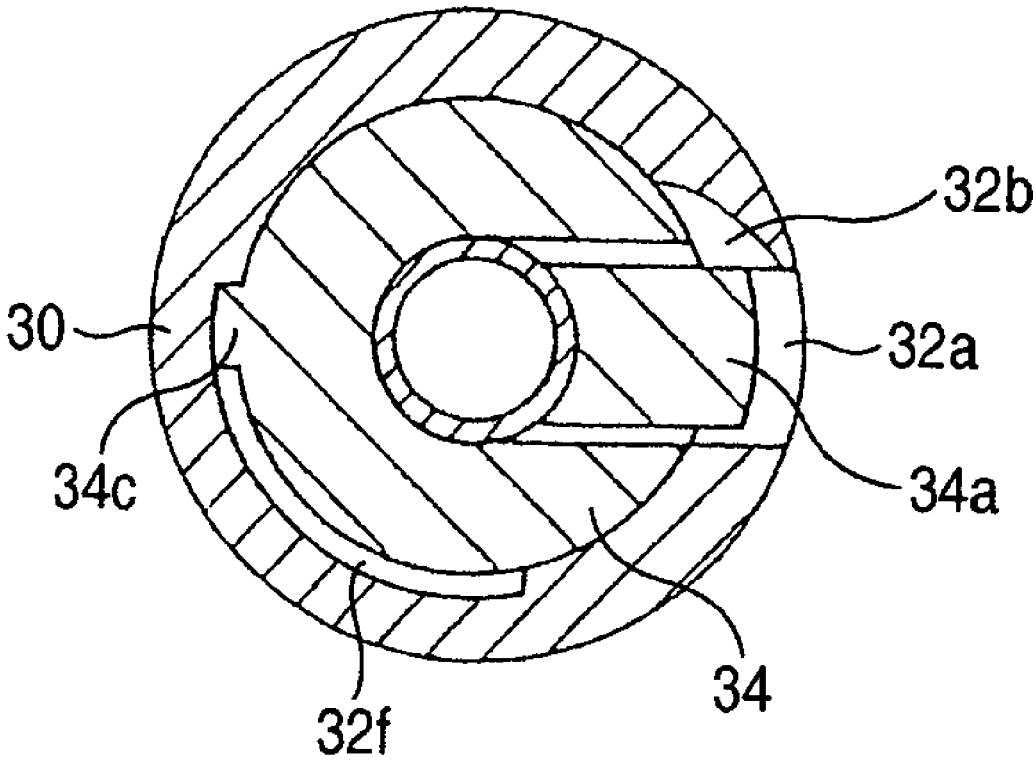
FIG. 15 is a section view taken along a line XV-XV in FIG. 13.

Next, a third embodiment of the invention will be described referring to FIGS. 13 to 15 for a case where an antenna is fixed to a casing body of a cellular phone in a projected manner.

Figure 13:
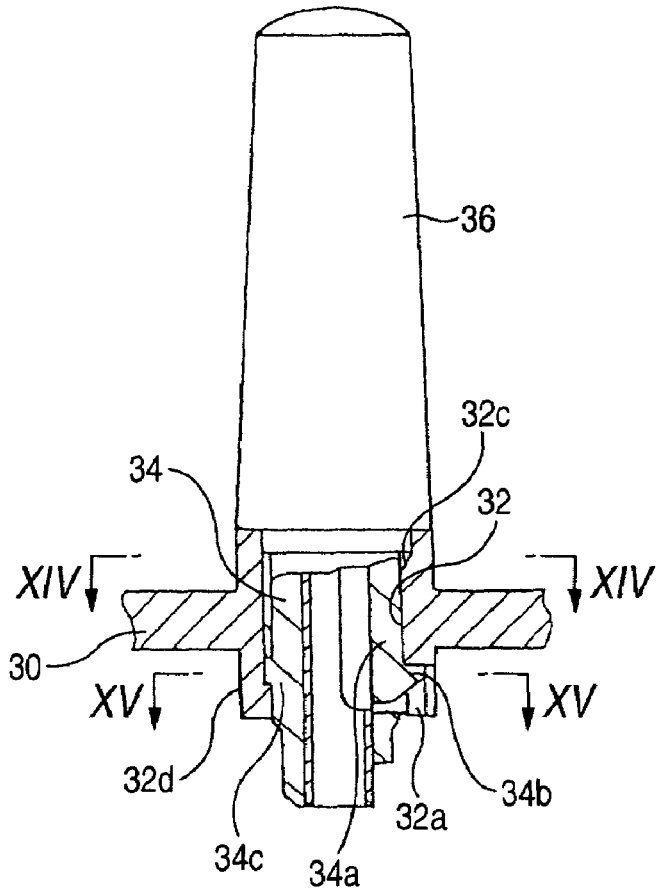
FIG. 13 is a partial section view of a fixing structure according to a third embodiment of the invention.

As shown in FIG. 13, a casing body 30 serving as a first member is provided with a through hole 32, and a cutout 32*a* is formed at an inside end part of the hole 32. Moreover, a slanted face 32*b* is formed on a side edge of the cutout 32*a* in a circumferential direction of the hole 32. Additionally, a chamfered part 32*c* is formed on an outside edge of the hole 32 at the same circumferential position as the cutout 32*a*. Further, two vertical grooves 32*d*, 32*e* are formed on an inner peripheral wall of the hole 32 so as to extend from the outside edge in the axial direction of the hole 32. Inner ends of these vertical grooves 32*d*, 32*e* are communicated with each other by a circumferential groove 32*f*.

On the other hand, a fixing member 34 serving as a second member is arranged at a base end of an antenna element 36. A tongue piece 34*a* is formed on the fixing member 34 in a cantilevered manner. The free end of the tongue piece 34*a* has an engaging part 34*b* which is projected outwardly from an outer peripheral face of the fixing member 34. The tongue piece 34*a* can be elastically deformed inwardly in a radial direction of the antenna element 36, until at least a distal end of the engaging part 34*b* comes into alignment with the outer peripheral face. Moreover, a projection 34*c* is formed on the outer peripheral face of the fixing member 34 near a lower end thereof.

In this embodiment, the width of the chamfered part 32*c* is set to be such a width that the tongue piece 34*a* of the fixing member 34 can pass through it. The projection 34*c* of the fixing member 34 is so adapted as to be opposed to one of the vertical grooves 32*d* which is formed on the inner peripheral face of the hole 32 from the outside edge, when the tongue piece 34*a* is aligned with the cutout 32*a* relative to the circumferential direction of the hole 32. Further, the projection 34*c* is so formed as to pass through the circumferential groove 32*f*, when the fixing member 34 is circumferentially rotated in such a direction that the tongue piece 34*a* may be brought into contact with the slanted face 32*b* of the cutout 32*a*. Thereafter, when the fixing member 34 is rotated up to a position where the tongue piece 34*a* is disengaged from the cutout 32*a*, the projection 34*c* which has passed through the circumferential groove 32*f* is adapted to arrive at the other vertical groove 32*e*.

With the above described structure, by inserting the tongue piece 34*a* and the projection 34*c* of the fixing member 34 respectively into the chamfered part 32*c* and the one vertical groove 32*d* of the hole 32, the fixing member 34 can be easily and reliably fixed. It is also possible to easily detach the fixing member 34, by circumferentially rotating the fixing member 34 from the fixed state, and withdrawing the fixing member 34 from the hole 32, after the rotation is restricted.

In the above described embodiments, all of the holes 12, 22, 32, the members 14, 24, 34 have a substantially circular cross section in a direction perpendicular to the axial direction thereof. However, they are not limited to have such a cross sectional shape, as long as the members 14, 24, 34 can be circumferentially rotated inside the holes 12, 22, 32 in order to disengage the tongue pieces 14*a*, 24*a*, 34*a* from the recess or cutout 12*b*, 22*a*, 32*a*. Further, they may be in any cross sectional shape, as long as the members 14, 24, 34 can be inserted into the holes 12, 22, 32, in case where a structure for disengaging the tongue pieces 14*a*, 24*a*, 34*a* by the circumferential rotation is not required.

What is claimed is:

1. A fixing structure, comprising:

a first member, formed with a hole having an inner wall formed with a recess at a first circumferential position; and a second member, formed with an elastic retainer which is retractably projected from an outer peripheral face of the second member and engaged with the recess when the second member is fitted into the hole, wherein a chamfered portion is formed on an aperture edge of the hole only at the first circumferential position, so as to have a width allowing the retainer to pass therethrough when the second member is fitted into the hole.

2. The fixing structure as set forth in claim 1, wherein at least one of an outer face of the retainer and a side face of the recess is formed with a slanted face which causes the retainer to be retracted inward when the second member is rotated within the hole in a circumferential direction of the hole from the state that the retainer engages with the recess.

3. A fixing structure, comprising:

a first member, formed with a hole having an inner wall formed with a recess at a first circumferential position and a first groove at a second circumferential position, the first groove extending from an aperture edge of the hole in an axial direction of the hole; and a second member, formed with a projection on an outer peripheral face thereof, and an elastic retainer which is retractably projected from the outer peripheral face and engaged with the recess when the second member is fitted into the hole, wherein the projection and the retainer are so arranged that the retainer is placed at the first circumferential position of the hole when the projection is received by the first groove to fit the second member into the hole.

4. The fixing structure as set forth in claim 3, wherein:

the inner wall of the hole is formed with a second groove at a third circumferential position so as to extend from the aperture edge of the hole in the axial direction of the hole, and a third groove extending in a circumferential direction of the hole so as to connect the first groove and the second groove;

at least one of an outer face of the retainer and a side face of the recess is formed with a slanted face; and the slant face causes the retainer to be retracted inward while the projection moves to the second groove through the third groove, when the second member is rotated within the hole in the circumferential direction of the hole from the state that the retainer engages with the recess.

* * * * *